US005085339A

United States Patent [19]

Roth et al.

[11] Patent Number: 5,085,339

[45] Date of Patent: Feb. 4, 1992

[54] RECLOSABLE CONTAINER CLOSURE

[75] Inventors: Donald J. Roth, Westport; William M. Heyn, New Canaan; Donald G. Sauer, Harwinton, all of Conn.

[73] Assignee: Polystar Packaging, Incorporated, Norwalk, Conn.

[21] Appl. No.: 591,275

[22] Filed: Oct. 1, 1990

[51] Int. Cl.[5] ..... B65D 17/32; B65D 43/16

[52] U.S. Cl. ..... 220/269; 220/359; 220/276; 220/307; 220/259; 220/270

[58] Field of Search ..... 220/359, 270, 269, 307, 220/276, 339, 254, 356, 259

[56] References Cited

U.S. PATENT DOCUMENTS

| | | | |
|---|---|---|---|
| 1,930,324 | 10/1933 | Stern | 220/307 |
| 2,767,754 | 10/1956 | Lederer et al. | 220/307 |
| 3,245,576 | 4/1966 | Griese, Jr. | 220/269 |
| 3,494,500 | 2/1970 | Foster | 220/269 |
| 3,628,689 | 12/1971 | Rogers | 220/270 |
| 4,165,016 | 8/1979 | Moller | 220/270 |
| 4,496,069 | 1/1985 | Winkless et al. | 220/260 |
| 4,609,123 | 9/1986 | Poncy | 220/258 |
| 4,724,978 | 2/1988 | Cleevely et al. | 220/258 |
| 4,724,979 | 2/1988 | Cleevely et al. | 220/258 |
| 4,856,708 | 8/1989 | Giasi | 220/359 X |

*Primary Examiner*—Stephen Marcus
*Assistant Examiner*—Vanessa Caretto
*Attorney, Agent, or Firm*—William H. Holt

[57] ABSTRACT

A reclosable closure for containers of the type used for keeping or storing product for some time following initial opening of the container. Typical uses would be for snack foods such as candies, peanuts, etc., and powdered products such as sugar, coffee, tea and other beverage mixes and the like. The closure also is adaptable for use with canned vagetables and meats and also with non-food products such as, for example, nails, tacks and a myriad of similar hardware items. The preferred closure includes an end panel and a ring-shaped frame member which are fused or otherwise adhered together during insert-injection molding of the frame member. Means are provided on the frame member for contacting an edge of the end panel, or an integral pull tab thereon, for restraining the end panel in a position for reclosing the container.

6 Claims, 2 Drawing Sheets

Fig. 8
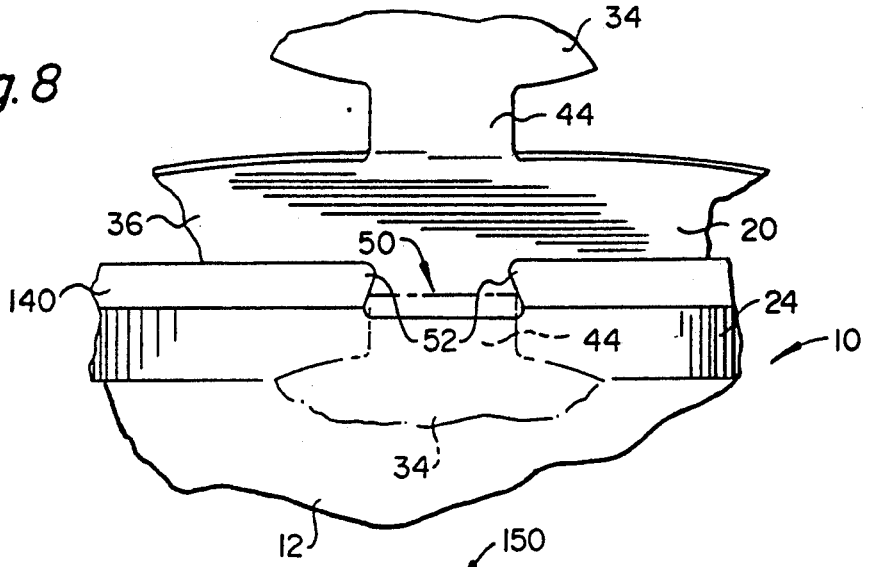
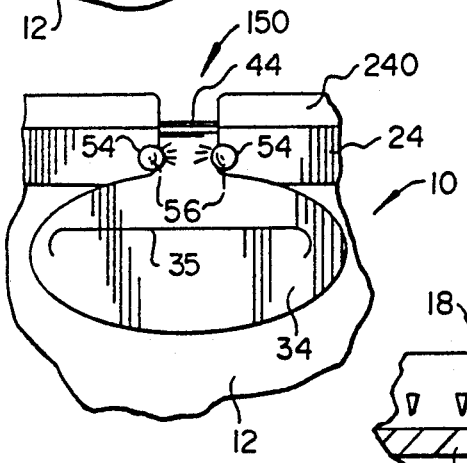
Fig. 9
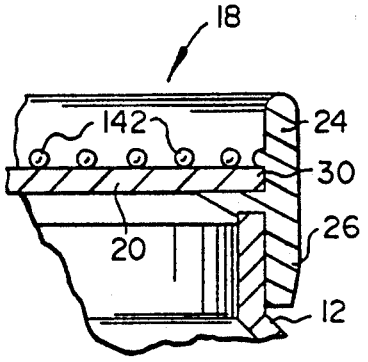
Fig. 6
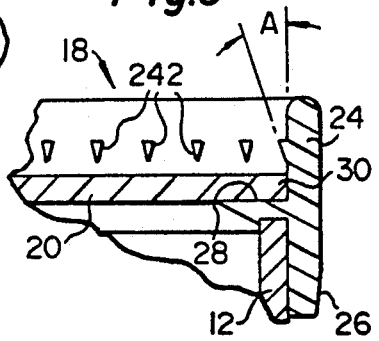
Fig. 7
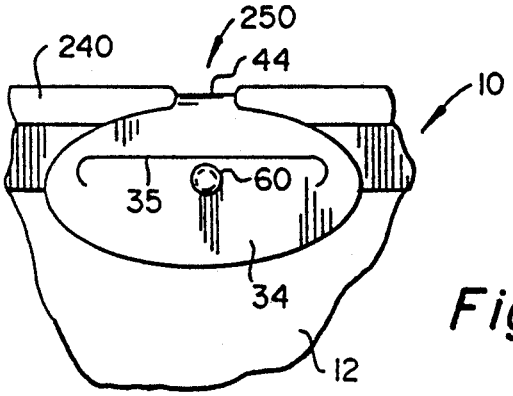
Fig. 10

RECLOSABLE CONTAINER CLOSURE

This invention relates to a closure for containers and, more particularly, to a closure in which an end panel thereof may be releasably secured over an opening in the container for reclosing the opening.

CROSS-REFERENCE TO RELATED APPLICATIONS

This invention is another in a series of inventions relating to containers and closures therefor. Two of our earlier cases are identified by Ser. No. 07/451,811 and 07/451,812, each of which was filed on Dec. 18, 1989, the disclosures of which are incorporated herein by reference.

BACKGROUND OF THE PRIOR ART

Heretofore, many different types of closures have been provided for containers. Some closures have been reusable to reclose containers, while many closures are not reusable. Examples of the former would be screw threaded lids and press-on lids, while examples of the latter would be pull tabs for easy-open beverage containers, metal can ends which are mechanically severed from the can body and full-opening metal ends which are detached from the container body.

BRIEF SUMMARY OF THE INVENTION

It is an object of the invention to provide a closure for a container, the closure comprising a frame member and an end panel, the frame member comprising an injection molded plastic ring member, means for attaching the end panel to the ring member, means for securing the frame member and the end panel to a container body, the end panel including a displaceable panel portion, means for displacing the panel portion from at least a portion of the ring member for providing an opening in the closure for gaining access to an interior of the container, and means for releasably securing the end panel over the opening for reclosing the opening.

Another object of the invention is to provide rib and hinge means for attaching the end panel to the closure and for allowing the end panel to assume an open position relative to the frame and the container.

A further object of the invention is to provide a means for attaching or bonding the end panel and frame member during molding or forming of the frame member.

A still further object of the invention is to provide the end panel with an integral pull tab for aiding in displacing a portion of the end panel from the frame member.

Another object of the invention is to provide means for releasably securing the end panel to the frame member, such means including a lip on the frame member for engaging with, or having bead means thereon for engaging with, an edge of the end panel.

Alternatively, another object of the invention is to provide the end panel with a pull tab and to provide the frame member with an opening for receiving part of the pull tab therein, or the frame member is provided with integral post means for engaging a portion of the pull tab for holding the end panel for reclosing the opening into the container.

A still further object of the invention is to provide the closure with tamper evidence indicator means.

Further and other objects of the invention will become more apparent from a consideration of the following detailed description, the accompanying drawings and the claimed subject matter.

BRIEF DESCRIPTION OF THE DRAWINGS

FIG. 6 is a view similar to FIG. 5 and shows a modified closure which includes a plurality of small, spaced bead members for engaging an edge of an end panel.

FIG. 7 is a view similar to FIGS. 5 and 6 and shows another modified closure which includes a plurality of small, generally triangularly shaped bead or lug members located slightly above the end panel to provide a form of light restraint against the end panel becoming displaced from closing the container.

FIG. 8 is an enlarged, fragmentary side view of a portion of the frame member and an associated end panel and shows a tapered opening in an upstanding lip of the frame member for receiving and securing (as is shown in broken lines) a tongue portion of a pull tab carried by the end panel.

FIG. 9 is a view similar to FIG. 8 and shows a modified form of the invention for securing the pull tab to the frame member by utilizing a pair of posts integral with the frame member.

FIG. 10 is a view similar to FIGS. 8 and 9 and shows a further modification of the invention for securing the pull tab to the frame member wherein a single post is integral with the frame member and protrudes through a pierced opening in the pull tab.

DETAILED DESCRIPTION OF THE INVENTION

Figure 1:
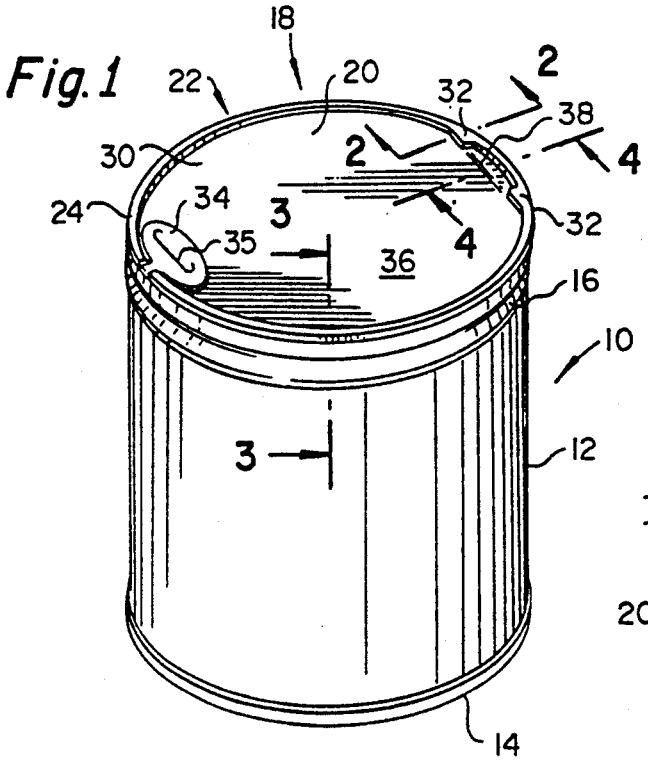
FIG. 1 is a perspective view of a container with a closure comprised of a ring-shaped frame member and an end panel affixed thereto.

FIG. 1 shows a container, generally indicated by the numeral 10, having a tubular side wall 12 and a bottom end 14. A top end 16 is provided with a closure, generally indicated by the numeral 18, having an end panel 20 and a, preferably injection molded plastic, frame member 22.

Container 10, including side wall 12, is preferably formed of metal, such as conventional tin plate or aluminum, etc., but is not limited thereto because the invention is readily usable with paperboard, plastic or glass containers, and the like, by using known joining methods such as crimping, securing with adhesives, or using threaded connection means.

Frame member 22 is comprised of an annular ring 24 having an outer wall 26 and an inwardly extending platform 28 for supporting a marginal edge portion 30 of end panel 20. In accord with our earlier inventions referred to above, it is preferred that end panel 20 be cut, or stamped, or pressed from single or multi-ply plastic sheet and inserted into a mold wherein frame member 22 is injection molded so that frame member 22 and end panel 20 are adhered together and form a seal along the inwardly extending platform 28, of frame member 22, and along the adjacent surface of marginal edge portion 30, of end panel 20. Also, as is best shown in FIGS. 1 and 2, end panel 20 is fixedly secured to frame member 22 by a pair of lugs or ribs 32 which capture a part of marginal edge portion 30 between platform 28 and ribs 32 and preclude end panel 20 from becoming completely detached from ring member 24 of closure 22.

In order to open container 10, end panel 20 is provided with a pull tab 34 which is preferably integral with end panel 20 but may be formed separately and then secured thereto. Pull tab 34 includes a cut line 35 which provides an opening so that pull tab 34 can open into the form of a pull ring. Upon the application of an upward pulling force to pull tab 34, the seal between platform 28 and the marginal edge portion 30 is broken so that a displaceable panel portion 36, of end panel 20, is moved upwardly and outwardly for separating and displacing the displaceable panel portion 36 from the ring member 24 for forming an opening in the container 10 to provide access to the contents.

Figure 2:
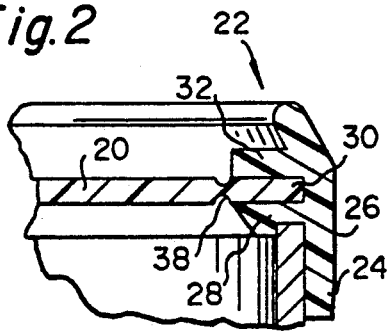
FIG. 2 is an enlarged, fragmentary sectional view, taken on line 2—2 of FIG. 1, and shows the end panel attached to the frame member by one of a pair of spaced ribs or lugs.
Figure 4:
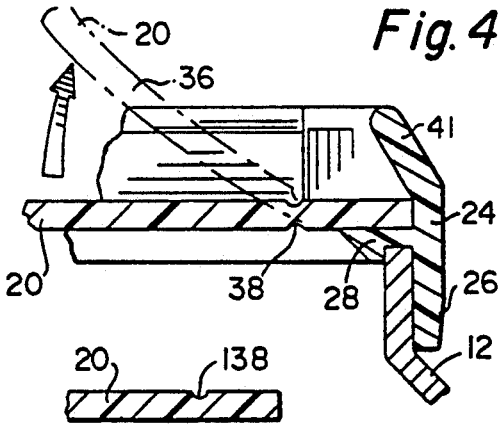
FIG. 4 is an enlarged, fragmentary sectional view, taken on line 4—4 of FIG. 1, and shows the end panel as being provided with a coined hinge portion for allowing the end panel to fold to an open position and remain there.
Figure 4A:
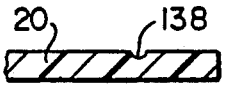
FIG. 4A is a fragmentary view and shows a modified form of coined hinge indented upon an upper surface of the end panel.
Figure 4B:
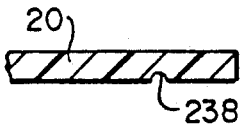
FIG. 4B is a fragmentary view and shows another modified form of coined hinge indented upon an underside of an end panel.

As is best shown in FIGS. 1, 2 and 4, end panel 20 is provided with a coined hinge 38, which may be cold-formed in the plastic sheet material, the hinge 38 being located at an end extending between the spaced lugs or ribs 32 (FIGS. 1 and 2). Hinge 38 functions to orient end panel 20 and allow it to stay in an opened condition; also, a reduction in mass along the hinge allows the displaceable panel portion 36 to fold easily between the opened and closed positions. Coined hinge 38 is shown in FIGS. 1, 2 and 4 as being coined into the upper and the lower surfaces of end panel 20 and provides a line about which displaceable panel portion 36, of end panel 20, can pivot. FIG. 4A shows a coined hinge 138 formed solely in the top surface of end panel 20, while FIG. 4B shows a coined hinge 238 formed in the lower, or inside, surface of end panel 20.

It is to be understood that displaceable panel portion 36, constitutes a major portion of end panel 20 and, as is shown in FIGS. 1 and 2, comprises the complete portion extending from pull tab 34 to the hinge 38 and excludes the minor portion comprised of the marginal edge portion 30 which is bounded by the ribs 32 and hinge 38.

Figure 3:
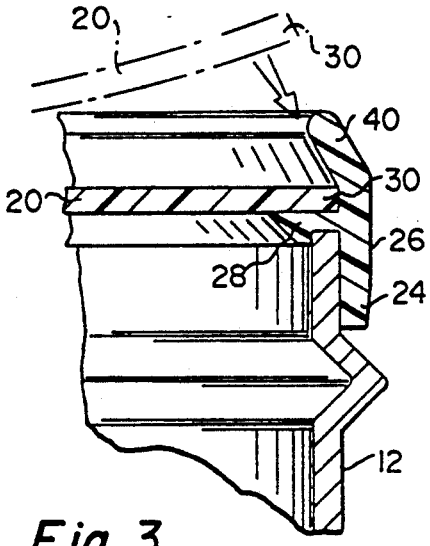
FIG. 3 is an enlarged, fragmentary sectional view, taken on line 3—3 of FIG. 1, and shows an upstanding lip of the frame member curved inwardly for contacting a portion of the end panel and holding the same in a position for reclosing the container.

After the displaceable panel portion 36, of end panel 20, is initially peeled from ring member 24 and access to the contents has been achieved, container 10 may be reclosed with end panel 20 secured in a closed position. This important feature of the invention may be accomplished is several different ways. As is shown in FIG. 3, along section line 3—3 of FIG. 1, the annular outer wall 26, of annular ring 24, includes an upper lip 40 which is curved inwardly and provides an interference fit for overlying (as is shown in solid lines) edge portion 30 of end panel 20 allowing for a snap-in closing and for releasably securing end panel 20 for reclosing the opening in container 10. While upper lip 40 is shown curved and annular, it is to be understood that a plurality of spaced canted portions 41 (FIG. 4) can effectively hold the end panel 20 in closed position.

Figure 5:
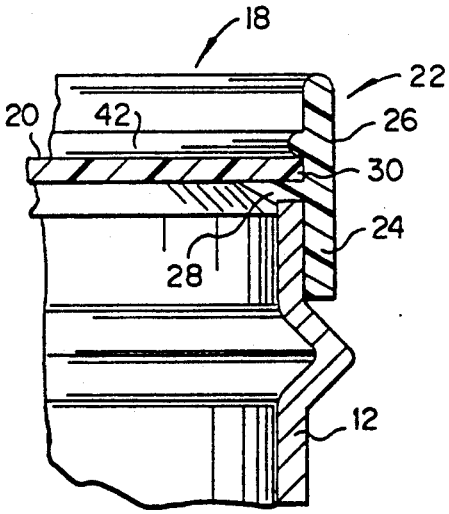
FIG. 5 is a fragmentary sectional view, similar to FIG. 3, and shows a modified closure wherein the frame member is provided with an elongated bead, generally hemispherical in section, for engaging and holding an edge of the end panel for securing the end panel in a position for reclosing the container.

FIG. 5 shows a modification of the invention wherein the upper portion of wall 26 extends generally vertically but is provided on its inside surface with an annular, semi-circular in section, bead 42 which is disposed to allow end panel 20 to snap-in and snap-out past bead 42 so that it will overlie and capture the marginal edge portion 30 for holding end panel 20 to reclose container 10.

FIG. 6 shows a modified form of the invention wherein a plurality of spaced, hemispherical, small beads 142 are disposed on the inner surface of annular ring 24 for allowing marginal edge portion 30, of end panel 20, to snap in and out and be captured by the beads 142 for snugly holding end panel 20 for reclosing the opening in container 10.

FIG. 7 shows a further modified form of the invention wherein a plurality of spaced, generally triangular in section, small spaced beads 242 are disposed on the inner surface of annular ring 24 for allowing marginal edge portion, of end panel 20, to snap in and out and be captured by the beads 242 for holding end panel 20 for reclosing the opening in container 10. A comparison of FIGS. 6 and 7 will show that the beads 142 will hold end panel 20 quite snugly while the beads 242 are slightly spaced upwardly from end panel 20 to provide a looser fit. Also, beads 242 are tapered upwardly and inwardly at an angle A, which may be in the range of 10° to 30°, thus allowing for lesser restraint, and easier passage of end panel 20 than is provided by beads 142.

FIGS. 8, 9 and 10 show several additional modifications for holding end panel 20 in place for reclosing the container 10.

FIG. 8 shows end panel 20 and pull tab 34 spaced slightly open and above ring 24 on the container 10. When it is desired that the container 10 be closed, pull tab 34 is moved downwardly so that the displaceable panel portion 26 closes the container 10. Pull tab 34 is provided with a tongue member 44 connected to end panel 20. Ring member 24 includes an upper lip portion 140 which is provided with a tapered opening, generally indicated by the numeral 50, which is bounded by upwardly and inwardly tapered shoulders 52 so that tongue member 44 can snap past the shoulders 52 and be received and secured within opening 50.

In FIG. 9 the annular ring 24 includes an upper lip 240 which has an opening 150 for receiving tongue member 44 connected with pull tab 34. Ring 24 is provided with a pair of spaced posts 54 which have enlarged heads 56 which allow tongue member 44 to snap past and be captured for holding the related end panel 20 (not shown in FIG. 9) in position for reclosing container 10.

In the modified version of FIG. 10, a headed post 60 is formed integral with annular ring 24 and may be disposed within an opening through pull tab 34 for securing tongue member 44 within an opening 250 formed in an upper lip 240 of ring 24 for thereby securing end panel 20 (not shown in FIG. 10) in position for reclosing container 10.

The invention also provides various means which will show evidence of tampering. In FIG. 1, the pull tab 34 is folded over and may have the underside thereof tack-welded or otherwise lightly fused to end panel 20; an upward pull on pull tab 34 will fracture the fused portion, thus showing evidence of possible tampering. Likewise, in FIG. 9, tongue member 44 may be fused to one or both of posts 54 to provide evidence showing initial opening of, or tampering with, container 10. Similarly, in FIG. 10, pull tab 34 and post 60 may be lightly fused together during manufacture, or assembly, for the purpose of providing assurance against tampering with container 10.

It is to be understood that end panel 20 may be of single or multiple-ply plastic and, along with annular ring 24, is formed of materials approved by the United States Food and Drug Administration for use in connection with food products and the like such as polypropylene, or maliated polypropylene, or other approved polyolefin material.

As a result of the previously referred to injection molding process, the molten polyolefin material which forms frame member 22 is hot enough to coact with the material of end panel 20 to form an adhesive bond. The bond provides an hermetic seal which is broken during opening of the container through cohesive failure of either the material of end panel 20 or, more likely, through failure of the material of the injection molded frame member 22.

While various preferred forms and features of the invention have been disclosed in the drawings and specifically described in the foregoing specification, it is to understood that the spirit and scope of the invention is not limited thereto but is to be defined and interpreted in accordance with the following claimed subject matter.

We claim:

1. A closure for a container, said closure comprising a frame member and an end panel, said frame member comprising an injection molded plastic ring member, means for attaching said end panel to said ring member, means for securing said frame member and said end panel to a container body, said end panel including a displaceable panel portion, means for displacing said panel portion from at least a portion of said ring member for providing an opening in said closure for gaining access to an interior of said container, and means for releasably securing said end panel over said opening for reclosing said opening, said means for releasably securing said end panel for reclosing said opening comprising means on said ring member cooperating with means on said end panel, said means on said end panel comprising a pull tab, and said means on said ring member comprising means for capturing said pull tab and securing said end panel over said opening.

2. A closure as defined in claim 1 wherein said pull tab includes a tongue member securing said pull tab to said end panel, said ring member having a lip, and an opening formed in said lip for receiving and securing said tongue therein.

3. A closure as defined in claim 2 wherein said lip includes spaced shoulder means adjacent said opening, said shoulder means extending upwardly and inwardly for defining said opening such that said tongue member will snap into and out of said opening during opening and closing of the container.

4. A closure as defined in claim 1 wherein said means on said ring member comprises post means integral therewith and engaging a portion of said pull tab.

5. A closure as defined in claim 4 including means for temporarily securing said post means and said pull tab to each other for providing a tamper evidence indicator means.

6. A closure as defined in claim 4 wherein said pull tab has an opening therein, said post means being disposed within said opening in said pull tab for capturing said pull tab.

* * * * *